US006427775B1

(12) United States Patent
Dusterhoft et al.

(10) Patent No.: US 6,427,775 B1
(45) **Date of Patent: *Aug. 6, 2002**

(54) METHODS AND APPARATUS FOR COMPLETING WELLS IN UNCONSOLIDATED SUBTERRANEAN ZONES

(75) Inventors: Ronald G. Dusterhoft; R. C. Jannise; Janet L. Roper; Audis Byrd, all of Katy; Travis Hailey, Sugar Land, all of TX (US); Philip D. Nguyen, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/399,674

(22) Filed: Sep. 21, 1999

Related U.S. Application Data

(63) Continuation-in-part of application No. 09/361,714, filed on Jul. 27, 1999, which is a continuation-in-part of application No. 09/084,906, filed on May 26, 1998, now Pat. No. 5,934,376, which is a continuation-in-part of application No. 08/951,936, filed on Oct. 16, 1997, now Pat. No. 6,003,600.

(51) Int. Cl.[7] ..... E21B 43/04; E21B 43/08
(52) U.S. Cl. ..... 166/278; 166/51; 166/236
(58) Field of Search ..... 166/273, 276, 166/51, 281, 227, 236

(56) References Cited

U.S. PATENT DOCUMENTS

| | | | |
|---|---|---|---|
| 2,207,334 A | 7/1940 | Reynolds et al. | 166/21 |
| 3,670,817 A | 6/1972 | Saucier | 166/252 |
| 4,042,032 A | 8/1977 | Anderson et al. | 166/276 |
| 4,070,865 A | 1/1978 | McLaughlin | 61/36 |
| 4,428,436 A | 1/1984 | Johnson | 172/372 |
| 4,770,336 A * | 9/1988 | Arterbury et al. | 166/380 |

(List continued on next page.)

FOREIGN PATENT DOCUMENTS

| | | | |
|---|---|---|---|
| EP | 0421822 | 4/1991 | E21B/37/08 |
| EP | 0909874 | 4/1999 | E21B/43/02 |
| EP | 0909875 | 4/1999 | E21B/43/04 |
| GB | 2317630 | 4/1998 | E21B/43/08 |
| GB | 2316967 | 3/1999 | E21B/43/04 |
| WO | 9304267 | 4/1993 | E21B/43/25 |
| WO | 9322536 | 11/1993 | E21B/43/08 |
| WO | 9416194 | 7/1994 | E21B/23/14 |
| WO | 9514844 | 6/1995 | E21B/43/04 |
| WO | WO 9533915 | 12/1995 | E21B/43/267 |
| WO | WO 0061913 | 10/2000 | E21B/43/04 |
| WO | WO 0114691 | 3/2001 | E21B/43/08 |
| WO | WO 0144619 | 6/2001 | E21B/43/04 |

OTHER PUBLICATIONS

Conceptual Development; concentric Alternate Path Screen Project; Nov. 3, 1998; (pp. 1–7).

Schlumberger Dowell; Alternate Path+Services; Feb. 1997; (pp. 9).

L. Jones; Petroleum Engineer International; Fracpacking Horizontal Wells Allows Ultra–High Rates From Medicore Formations; Jul. 1999; (pp.37–40).

*Primary Examiner*—David Bagnell
*Assistant Examiner*—John Kreck
(74) *Attorney, Agent, or Firm*—Paul I. Herman; Conley, Rose & Tayon

(57) ABSTRACT

Improved methods and apparatus for completing an unconsolidated subterranean zone penetrated by a well bore are provided. The methods basically comprise the steps of placing a slotted liner having an internal sand screen disposed therein with dividers extending between the screen and liner, isolating the slotted liner and the well bore in the zone and injecting particulate material into flow paths formed by the dividers between the sand screen and the slotted liner and into the annulus between the slotted liner and the well bore to thereby form packs of particulate material therein to prevent the migration of fines and sand with produced fluids.

28 Claims, 7 Drawing Sheets

U.S. PATENT DOCUMENTS

| | | | | |
|---|---|---|---|---|
| 4,829,100 | A | | 5/1989 | Murphey et al. ..... 523/131 |
| 4,945,991 | A | | 8/1990 | Jones ..... 166/278 |
| 5,058,676 | A | | 10/1991 | Fitzpatrick et al. ..... 166/278 |
| 5,082,052 | A | | 1/1992 | Jones et al. ..... 166/51 |
| 5,113,935 | A | | 5/1992 | Jones et al. ..... 166/51 |
| 5,128,390 | A | | 7/1992 | Murphey et al. ..... 523/130 |
| 5,161,613 | A | | 11/1992 | Jones ..... 166/242 |
| 5,161,618 | A | | 11/1992 | Jones et al. ..... 166/308 |
| 5,333,688 | A | | 8/1994 | Jones et al. ..... 166/278 |
| 5,341,880 | A | | 8/1994 | Thorstensen et al. ..... 166/278 |
| 5,417,284 | A | | 5/1995 | Jones ..... 166/280 |
| 5,419,394 | A | | 5/1995 | Jones ..... 166/51 |
| 5,435,391 | A | | 7/1995 | Jones ..... 166/308 |
| 5,476,143 | A | | 12/1995 | Sparlin et al. ..... 166/233 |
| 5,515,915 | A | | 5/1996 | Jones et al. ..... 166/51 |
| 5,560,427 | A | | 10/1996 | Jones ..... 166/280 |
| 5,579,844 | A | | 12/1996 | Rebardi et al. ..... 166/296 |
| 5,588,487 | A | | 12/1996 | Bryant ..... 166/51 |
| 5,609,204 | A | | 3/1997 | Rebardi et al. ..... 166/51 |
| 5,609,207 | A | | 3/1997 | Dewprashad et al. ..... 166/276 |
| 5,669,445 | A | | 9/1997 | Edwards ..... 166/278 |
| 5,890,533 | A | | 4/1999 | Jones ..... 166/51 |
| 5,934,376 | A | * | 8/1999 | Nguyen et al. ..... 166/278 |
| 5,957,205 | A | * | 9/1999 | Bohme et al. ..... 166/296 |
| 6,003,600 | A | | 12/1999 | Nguyen et al. ..... 166/281 |
| 6,220,345 | B1 | | 4/2001 | Jones et al. ..... 166/51 |

* cited by examiner

2/6

METHODS AND APPARATUS FOR COMPLETING WELLS IN UNCONSOLIDATED SUBTERRANEAN ZONES

RELATED APPLICATIONS

This application is a continuation-in-part of U.S. patent application Ser. No. 09/361,714 filed on Jul. 27, 1999, which is a continuation-in-part of U.S. patent application Ser. No. 09/084,906 filed on May 26, 1998, now U.S. Pat. No. 5,934,376, which is a continuation-in-part of U.S. patent application Ser. No. 08/951,936 filed on Oct. 16, 1997 now U.S. Pat. No. 6,003,600 all hereby incorporated herein by reference.

BACKGROUND OF THE INVENTION

1. Field of the Invention

The present invention relates to improved methods and apparatus for completing wells in unconsolidated subterranean zones, and more particularly, to improved methods and apparatus for achieving a uniform pack during gravel or frac packs in completing such wells whereby the migration of fines and sand with the fluids produced therefrom is prevented.

2. Description of the Prior Art

Oil and gas wells are often completed in unconsolidated formations containing loose and incompetent fines and sand which migrate with fluids produced by the wells. The presence of formation fines and sand in the produced fluids is disadvantageous and undesirable in that the particles abrade and damage pumping and other producing equipment and reduce the fluid production capabilities of the producing zones in the wells.

Unconsolidated subterranean zones are stimulated by creating fractures in the zones and depositing particulate proppant material in the fractures to maintain them in open positions. In addition, the proppant can be consolidated within the fractures into hard permeable masses to reduce the migration of formation fines and sands through the fractures with produced fluids.

Gravel/frac packs, which include sand screens and the like, are commonly installed in the well bores penetrating unconsolidated zones. The gravel packs serve as filters and help to assure that fines and sand do not migrate with produced fluids into the well bores.

In a typical gravel/frac pack completion, a screen is placed in the well bore and positioned within the unconsolidated subterranean zone which is to be completed. The screen is typically connected to a tool which includes a production packer and a cross-over, and the tool is in turn connected to a work or production string. A particulate material, which is usually graded sand, often referred to in the art as gravel, is pumped in a slurry down the work or production string and through the cross over whereby it flows into the annulus between the screen and the well bore. The liquid forming the slurry leaks off into the subterranean zone and/or through the screen which is sized to prevent the sand in the slurry from flowing therethrough. The sand in the slurry has a very high permeability. As the fluid leaks off into the perforations into the formation and back into the screen, the sand is deposited in the annulus around the screen where it forms a gravel pack. The size of the sand in the gravel pack is selected such that it prevents formation fines and sand from flowing into the well bore with produced fluids.

During a gravel-packing operation, it is imperative to pack the gravel in the perforations and along the entire length of the screen. Conventional gravel packing begins at the bottom of the screen and packs upward. However, with a high leak off of fluid through the perforations in the formation, more and more sand is deposited around the perforations thus forming a node around the perforations. A node is a build up of sand which can grow radially so as to form a bridge and completely block the annular area between the screen and well bore. Although the primary flow of the gravel pack slurry is axial, as the nodes around the perforations build, the flow becomes radial due to the sand build up thus causing the nodes to grow radially around the annulus. If permeability variations and/or the hole geometry cause a gravel bridge to form in the annulus around the screen during packing, the gravel slurry will begin packing upward from the bridge. This is particularly a problem in gravel packs in long and/or deviated unconsolidated producing intervals. The resulting incomplete annular pack has sections of screen that remain uncovered, which can lead to formation sand production and eventual failure of the completion.

FIG. 1 illustrates the problem of the formation of sand bridges 50 in the annulus 52 near the middle of the screen 54 resulting in a non-uniform sand packing of the annulus 52 between the screen 54 and the well bore 56. This often occurs as a result of the loss of carrier liquid from the sand slurry into high permeability portions of the subterranean zone 58 which in turn causes the formation of sand bridges 50 in the annulus 52 before all the sand has been placed. The sand bridges block further flow of the slurry through the annulus 52 which leaves voids 60, 62 in the annulus 52. When the well is placed on production, the flow of produced fluids is concentrated through the voids 60, 62 in the gravel pack which soon causes the screen 54 to be eroded and the migration of fines and sand with the produced fluids to result.

In attempts to prevent the formation of sand bridges in gravel pack completions, special screens having internal shunt tubes have been developed and used. See for example U.S. Pat. No. 4,945,991. While such screens have achieved varying degrees of success in avoiding sand bridges, they, along with the gravel packing procedure, are very costly.

Further improved apparatus and methods of preventing sand bridges are shown in U.S. patent application Ser. No. 09/361,714 filed on Jul. 27, 1999, which is a continuation-in-part of application Ser. No. 09/084,906 filed on May 26, 1998, now U.S. Pat. No. 5,934,376, which is a continuation-in-part of application U.S. Pat. Ser. No. 08/951,936 filed on Oct. 16, 1997, all hereby incorporated herein by reference. See also European patent application EP 0 909 874 A2 published Apr. 21, 1999 and European patent application EP 0 909 875 A2 published Apr. 21, 1999, both hereby incorporated herein by reference. A slotted liner, having an internal sand screen disposed therein, is placed within an unconsolidated subterranean zone whereby an inner annulus is formed between the sand screen and the slotted liner. The inner annulus is isolated from the outer annulus between the slotted liner and the well bore in the zone and provides an alternate flow path for the particulate material. Particulate material is injected into the inner annulus and outer annulus between either or both the sand screen and the slotted liner and the liner and the zone by way of the slotted liner whereby the particulate material is uniformly packed into the annuli between the sand screen and the slotted liner and between the slotted liner and the zone. If a bridge forms in the outer annulus, then the alternate flow path through the inner annulus allow the filling of the void beneath the bridge in the outer annulus. The permeable pack of particulate material formed prevents the migration of formation fines and sand with fluids produced into the well bore from the unconsolidated zone. Sand bridges may still, however, form in both the inner and outer annuli causing voids in the gravel pack.

Thus, there are needs for improved methods and apparatus for completing wells in unconsolidated subterranean zones whereby the migration of formation fines and sand with produced fluids can be economically and permanently prevented while allowing the efficient production of hydrocarbons from the unconsolidated producing zone.

SUMMARY OF THE INVENTION

The present invention provides improved methods and apparatus for completing wells, and optionally simultaneously fracture stimulating the wells, in unconsolidated subterranean zones which meet the needs described above and overcome the deficiencies of the prior art. The improved methods basically comprise the steps of placing a slotted liner having an internal sand screen disposed therein with dividers extending between the liner and screen whereby alternative flow paths in an inner annulus are formed between the sand screen and the slotted liner in an unconsolidated subterranean zone, isolating the outer annulus between the slotted liner and the well bore in the zone, injecting particulate material into either or both the flow paths between the sand screen and the slotted liner and the outer annulus between the liner and the zone by way of the slotted liner whereby the particulate material is uniformly packed into the annuli between the sand screen and the slotted liner and between the slotted liner and the zone. The alternate flow paths prevent voids from forming beneath nodes or bridges in either the inner or outer annuli thereby achieving a uniform pack. The permeable pack of particulate material formed prevents the migration of formation fines and sand with fluids produced into the well bore from the unconsolidated zone.

As mentioned, the unconsolidated formation can be fractured prior to or during the injection of the particulate material into the unconsolidated producing zone, and the particulate material can be deposited in the fractures as well as in the annuli between the sand screen and the slotted liner and between the slotted liner and the well bore.

The apparatus is basically comprised of a slotted liner having an internal sand screen assembly disposed therein. The internal sand screen assembly includes a base member and sand screen with dividers or channelizers extending between the slotted liner and sand screen whereby alternative flow paths are formed in the inner annulus between the sand screen and the slotted liner, a cross-over, adapted to be connected to the production string, is attached to the slotted liner and sand screen assembly and a production packer is attached to the cross-over.

The channelizers, extending between the slotted liner and internal sand screen, divide the inner annulus into a plurality of alternate flow paths. Thus, as nodes build across the inner annulus, the channelizers break up the node. Although the node may plug one of the alternative flow paths between adjacent channelizers, the channelizers prevent the node from extending into one of the other alternative flow paths thus preventing the node from becoming a bridge blocking the entire inner annulus.

The improved methods and apparatus of this invention avoid the formation of voids beneath sand bridges in the inner annulus between the slotted liner and sand screen and in the outer annulus between the slotted liner and the well bore thereby producing a very effective sand screen for preventing the migration of fines and sand with produced fluids.

It is, therefore, a general object of the present invention to provide improved methods of completing wells in unconsolidated subterranean zones.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

The present invention provides improved methods of completing, and optionally simultaneously fracture stimulating, an unconsolidated subterranean zone penetrated by a well bore. The apparatus and methods may be used in either vertical or horizontal well bores and in either bore holes which are open-hole or have casing cemented therein. The term "vertical well bore" as used herein means the portion of a well bore in an unconsolidated subterranean producing zone to be completed which is substantially vertical or deviated from vertical in an amount up to about 30°. A highly deviated well is often considered to be in the range of 30° to 700°. The term "horizontal well bore" as used herein means the portion of a well bore in an unconsolidated subterranean producing zone to be completed which is substantially horizontal or at an angle from vertical in the range of from about 70° to about 90° or more.

Figure 1:
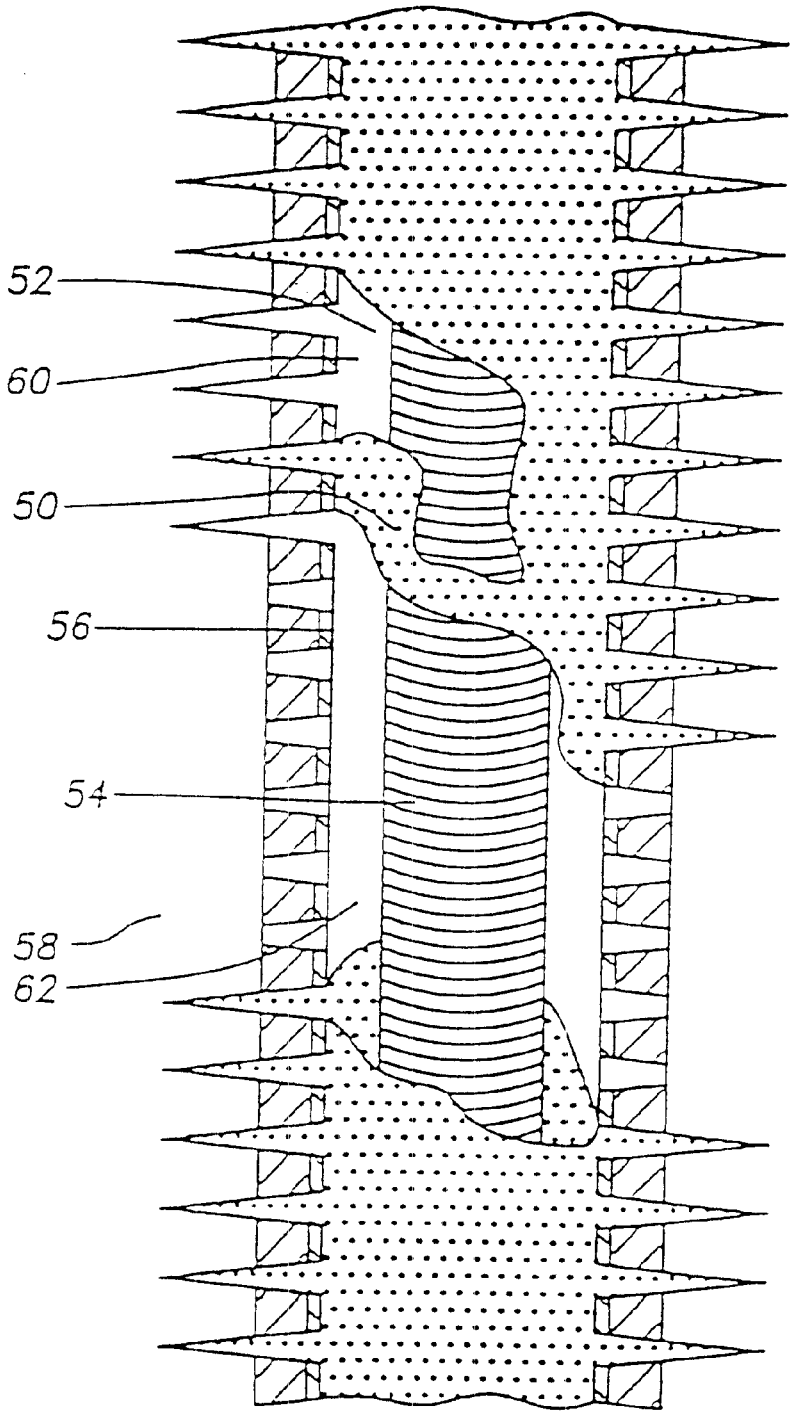
FIG. 1 (PRIOR ART)
FIG. 1 illustrates the problems of prior art gravel packs where sand bridges and voids are formed in the gravel pack.
Figure 2:
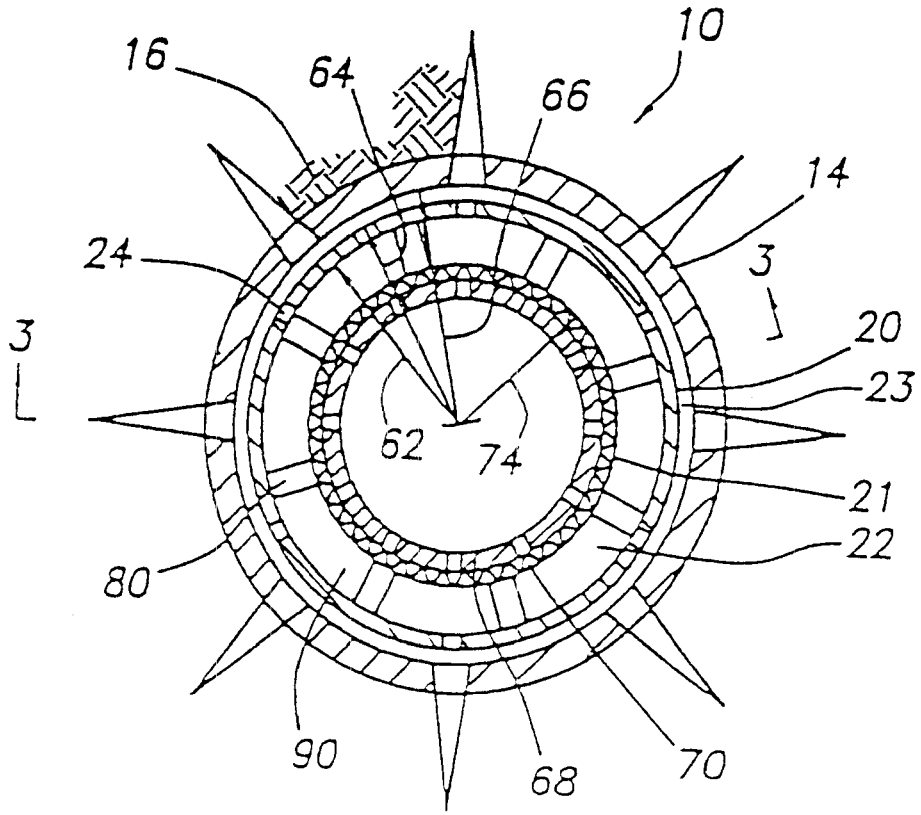
FIG. 2 is a cross sectional view taken perpendicular to the axis of the well bore penetrating an unconsolidated subterranean producing zone having casing cemented therein and having a slotted liner with an internal sand screen assembly.
Figure 3:
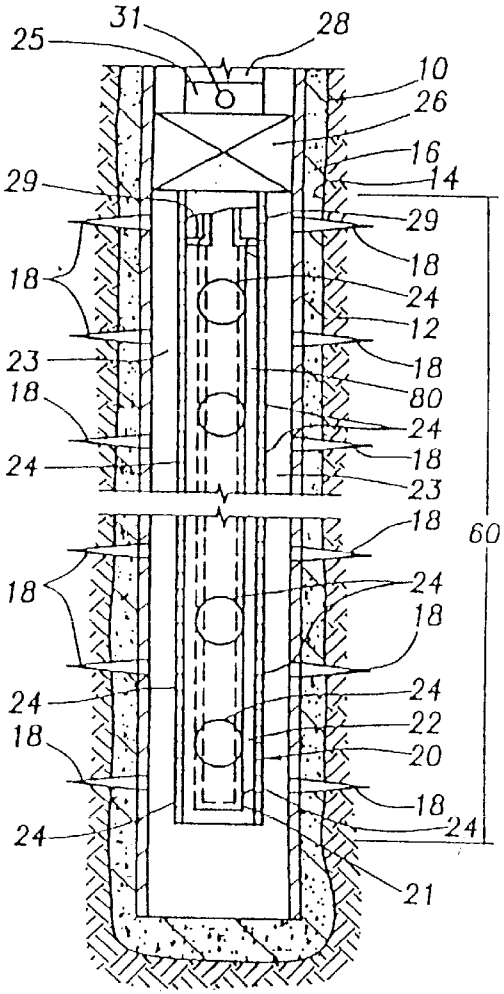
FIG. 3 is a side-cross sectional view taken at plane 3—3 in FIG. 2 of a well bore penetrating an unconsolidated subterranean producing zone having casing cemented therein and having a slotted liner with an internal sand screen, a production packer and a cross-over connected to a production string disposed therein.

Referring now to the drawings and particularly to FIGS. 2–3, a vertical well bore 10 having casing 14 cemented therein is illustrated extending into an unconsolidated subterranean zone 12. The casing 14 is bonded within the well bore 10 by a cement sheath 16. A plurality of spaced perforations 18, produced in the well bore 10 utilizing conventional perforating gun apparatus, extend through the casing 14 and cement sheath 16 into the unconsolidated producing zone 12.

In accordance with the apparatus and methods of the present invention, a slotted liner 20, having an internal sand screen assembly 21 installed therein forming an inner annulus 22 between the sand screen assembly 21 and the slotted liner 20, is placed in the well bore 10. The slotted liner 20 and sand screen assembly 21 have lengths such that they substantially span the length of the producing interval 60 in the well bore 10. The slotted liner 20 has a predetermined inner diameter 62 and outer diameter 64 such that when liner 20 is disposed within the well bore 10, a predetermined outer annulus 23 is formed between liner 20 and the casing 14 since the inner diameter 66 of casing 14 is known. Liner 20 has perforations or slots 24 which can be circular as illustrated in the drawings, or they can be rectangular or other shape. Slots 24 have a predetermined flow area, determined by their cross-section and density per foot of liner, providing a predetermined aggregate flow area through slotted liner 20. The size and shape of the slots 24 are preferably optimized using numeric modeling techniques. Factors such as carrier fluid reheology and injection rate, casing inside diameter, slotted liner 20 inside and outside diameter, and screen outside diameter are important to determine the optimum configuration. Special consideration to ensure desired production rates can be maintained is also important.

Screen assembly 21 includes a screen 70 disposed over a base member 68, such as a pipe. Base member includes perforations or slots 72 which can be circular or another shape such as rectangular. Screen 70 has a predetermined outside diameter 74 such that the inner diameter 62 of liner 20 and the outside diameter 74 of screen 70 provide a predetermined flow area through inner annulus 22. Screen assembly further includes a plurality of centralizers or channelizers 80 extending between screen 70 and liner 20 which divides inner annulus 22 into a plurality of alternate flow paths 90. Although the sand screen assembly 21 of FIG. 2 has been shown to be concentric within liner 20, it should be appreciated that screen assembly 21 may be non-concentric within liner 20.

As shown in FIGS. 2–3, the slotted liner 20 and sand screen assembly 21 are connected to a cross-over 25 which is in turn connected to a production string 28. A production packer 26 is attached to the cross-over 25. The cross-over 25 and production packer 26 are conventional gravel pack forming tools and are well known to these skilled in the art.

Figure 4:
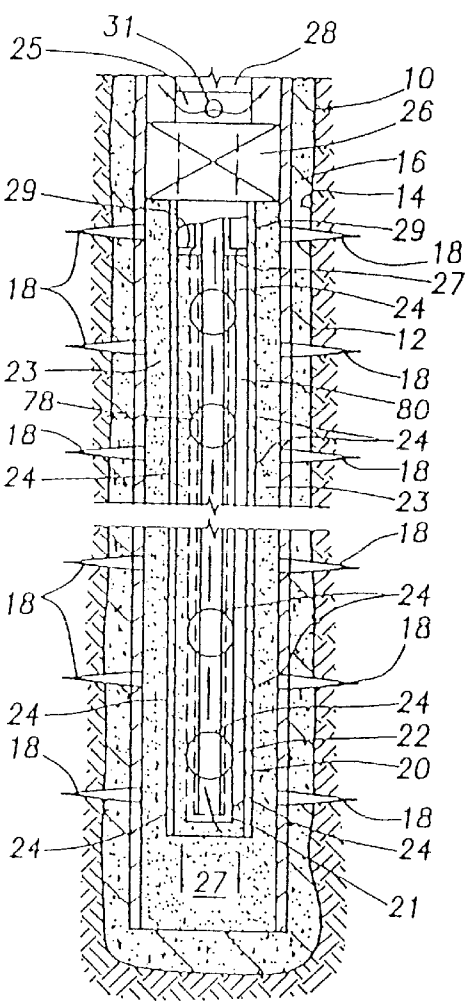
FIG. 4 is a side cross sectional view of the well bore of FIG. 3 after particulate material has been packed therein.

Referring to FIG. 4, during the gravel pack operation, a wash pipe 78 is suspended and sealed within the cross-over 25 and is extended to the lower end of the screen assembly 21. The flowbore of the wash pipe 78 provides a return path for the fluids in the slurry such that the fluids may pass upwardly into the work string and casing annulus to the surface. The wash pipe 78 prevents the fluids in the slurry from prematurely flowing to the surface through the screen assembly 21.

The cross-over 25 is a sub-assembly which allows fluids to follow a first flow pattern whereby particulate material suspended in a slurry can be packed in the annuli 22, 23 between the sand screen assembly 21 and the slotted liner 20 and between the slotted liner 20 and the well bore 10. That is, as shown by the arrows, the particulate material suspension flows from inside the production string 28 to the alternative flow paths 90 in inner annulus 22 between the sand screen assembly 21 and slotted liner 20 by way of two or more ports 29 in the cross-over 25. Simultaneously, fluid is allowed to flow into the lower end of the wash pipe 78 and upwardly through the cross-over 25 to the other side of the packer 26 outside of the production string 28 by way of one or more ports 31 in the cross-over 25. By pipe movement dr other procedure, flow through the cross-over 25 can be selectively changed to a second flow pattern (shown in FIG. 5) by removing the wash pipe 78 whereby fluid from inside the sand screen assembly 21 flows directly into the production string 28 and the ports 31 are shut off. The production packer 26 is set by pipe movement or other procedure whereby the outer annulus 23 is sealed.

After the slotted liner 20 and sand screen assembly 21 are placed in the well bore 10, the outer annulus 23 between the slotted liner 20 and the casing 14 is isolated by setting the packer 26 in the casing 14 as shown in FIG. 3. Thereafter, as shown in FIG. 4, a slurry of particulate material 27 is injected into the alternative flow paths 90 in inner annulus 22 between the sand screen assembly 21 and the slotted liner 20 by way of the ports 29 in the cross-over 25 and into the outer annulus 23 between the slotted liner 20 and the casing 14 by way of the slots 24 in the slotted liner 20.

The particulate material flows into the perforations 18 and fills the interior of the casing 14 below the packer 26 except for the interior of the sand screen assembly 21. That is, as shown in FIG. 4, a carrier liquid slurry of the particulate material 27 is pumped from the surface through the production string 28 and through the cross-over 25 into the alternate flow paths 90 in inner annulus 22 between the sand screen assembly 21 and the slotted liner 20. From the inner annulus 22, the slurry flows through the slots 24 and through the open end of the slotted liner 20 into the outer annulus 23 and into the perforations 18.

Alternatively, the upper end of slotted liner 20 may be open below packer 26 to receive a flow of the slurry from production string 28 such that the slurry flows into both inner annulus 22 and outer annulus 23 substantially simultaneously from cross-over 25 or the slurry may flew into just outer annulus 23 and then by way of the slots 24 into inner annulus 22 to pack as described above.

Typically, gravel packing initially occurs at the bottom of the bore hole and then accumulates upwardly in a vertical bore hole. The particulates, i.e., the sand or solids, in the slurry settle out as the fluids in the slurry leak off. The leak off of the fluid into the wash pipe carries the particulates down the interval past the screen and wash pipe and is merely the fluid separating from the particulates and depositing the particulates in the bore hole. The particulates do not begin to pack until they become dehydrated due to the leak off of the fluids. The carrier fluid in the slurry leaks off through the perforations 18 into the unconsolidated zone 12 and through the lower end of the wash pipe 78 where it flows upwardly through cross-over 25 and into the casing 14 above the packer 26 by way of the ports 31. This causes the particulate material 27 to be uniformly packed in the perforations 18, in the outer annulus 23 between the slotted liner 20 and the casing 14 and within the inner annulus 22 between the sand screen assembly 21 and the interior of the slotted liner 20.

The centralizers 80 act as flow straighteners by promoting axial flow through inner annulus 22 and inhibiting radial flow between slotted liner 20 and sand screen assembly 21. As fluid leaks off through the slots 24 in slotted liner 20, sand is deposited around slots 24 promoting the build up of sand inside liner 20 adjacent slots 24 causing a node to be formed. The node develops an angle of repose of the sand causing radial flow as the slurry passes downward through inner annulus 22 and over the node. As the node grows and engages adjacent channelizers 80, the growth of the node is stopped. Since the node has reduced the flow area through one of the alternate flow paths 90, the velocity of the slurry is increased through the other alternative flow paths 90 in inner annulus 22. This increased velocity also tends to inhibit node growth. Since the fluid cannot flow radially around inner annulus 22 due to centralizers 80, the node cannot grow further to form a bridge. Thus, the centralizers 80, providing the plurality of alternative flow paths 90, prevent the formation of a bridge which blocks flow through the entire inner annulus 22.

The building of nodes is one of the primary methods of gravel packing the bore hole. However, if the nodes form prematurely and build bridges across the outer annulus 23, voids can be formed in the gravel pack which are undesirable. Thus, if a node, does begin to build prematurely, it is important that an alternative flow path past the node be provided such that any void forming beneath the bridge can be gravel packed from underneath the bridge so as to fill the void to achieve a uniform gravel pack throughout the annuli.

Alternative flow paths 90 provide a plurality of alternative flow paths to the gravel slurry flowing down the outer annulus 23. Without the centralizers 80, there are just two flow paths for the slurry, i.e. the inner annulus 22 and the outer annulus 23. The centralizers 80 divide the inner annulus 22 into a plurality of flow paths so as to provide multiple alternative paths 90 through the inner annulus 22 and into the outer annulus 23. As the fluid and slurry passes through the perforations in the casing 14, sand will build around the perforations 18 again forming a node. As that node builds, it may form a bridge across outer annulus 23. However, because of the plurality of alternative flow paths 90 through the inner annulus 22, if one of the alternative paths 90 becomes plugged or if the outer annulus 23 becomes plugged, the other alternative paths 90 provided through inner annulus 22 allow the gravel slurry to by-pass the bridge and flow to a point beneath the bridge so as to fill with gravel any void being formed below the bridge. Thus, even if a bridge forms in outer annulus 23 or if nodes form in one of the alternative flow paths 90, channelizers 80 provide a plurality of other alternate flow paths 90 to fill and complete the gravel pack in both the inner and outer annuli 22, 23. Thus, the present invention achieves the objective of filling any voids and providing a continuous gravel pack throughout inner annulus 22 and outer annulus 23 such that all voids have been filled and there are no voids in the gravel pack upon completion of the operation.

The aggregate flow area through slots 24 in slotted liner 20 is optimized with respect to the aggregate flow area through the alternative flow paths 90 in inner annulus 22. The aggregate flow area through slotted liner 20 is defined by the size of the slots 24 and by the hole density, ie. number of slots 24 per foot of liner 20. The aggregate flow area through alternative flow paths 90 is determined by the spacing between the screen 124 and the outer shroud 120. This spacing is determined by the radius 74 of screen 124 and the inside diameter 162 of slotted liner 20. The number and width of the individual channelizers 80 also are a factor in determining the aggregate flow area through alternative flow paths 90 in inner annulus 22. Since the channelizers 80 tend to reduce the building of nodes in inner annulus 22, channelizers 80 increase thereby increase flow through the inner annulus 22 and thus allow an increase in flow through the slotted liner 20.

It is preferable to maximize the aggregate flow area through slotted liner 20 so as to maximize the flow of well fluids produced through the slotted liner 20 from the production zone. If the flow area through slotted liner 20 is reduced too much, the reduced flow area will prevent full production of well fluids from the production zone. However, if the aggregate flow area through slotted liner 20 is too great as compared to the aggregate flow area through the alternative flow paths 90, then the slurry will tend to pass through slotted liner 20 and down outer annulus 23 rather than through alternate flow paths 90 thereby rendering alternative flow paths 90 ineffective in ensuring any voids in the annuli 22, 23 are filled. Thus, it is important to optimize the aggregate flow radially through slotted liner 20 with the aggregate flow axially downward through alternative flow paths 90 in inner annulus 22. It should be appreciated that the optimization of these aggregate flow areas will vary with the diameter of casing 14 in a cased bore hole or with the diameter of an open earthen bore hole.

It can be appreciated that the greater the outside diameter of slotted liner 20, the greater the aggregate flow area through slotted liner 20. However, some clearance is required between slotted liner 20 and the well bore 10. For example, liner 20 cannot have a diameter which would prevent a safe installation downhole in the well bore 10. Another practical factor is the necessity of having sufficient clearance around slotted liner 20 to permit remedial or fishing operations to retrieve slotted liner 20 and sand screen assembly 21. Fishing operations typically include a fishing tool having a mill and grapple for receiving and attaching the upper end of liner 20 to the fishing tool. For fishing operations, typically at least a ½ inch clearance and preferably a ¾ to 1 inch clearance is provided around the outside of the liner to provide an adequate clearance for grappling the end of the liner with the fishing tool to retrieve the liner and sand screen should it become necessary.

One preferred embodiment includes making the slotted liner 20 from a non-metal material, such as a composite or fiberglass, which would allow the fishing tool to mill down the liner 20 and then allow the fishing tool to grapple the remainder of the assembly. This would allow the maximization of the outside diameter of slotted liner 20 to provide a maximized or optimized flow area through slots 24 in liner 20.

Figure 5:
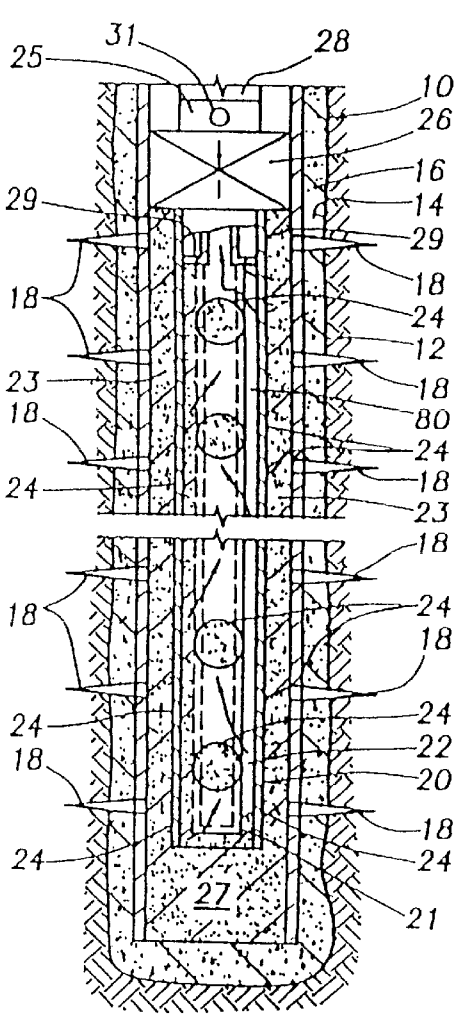
FIG. 5 is a side cross sectional view of the well bore of FIG. 3 after the well has been placed on production.

After the particulate material has been packed into the well bore 10 as described above, the well is returned to production as shown in FIG. 5. The pack of particulate material 27 formed filters out and prevents the migration of formation fines and sand with fluids produced into the well bore from the unconsolidated subterranean zone 12.

Figure 6:
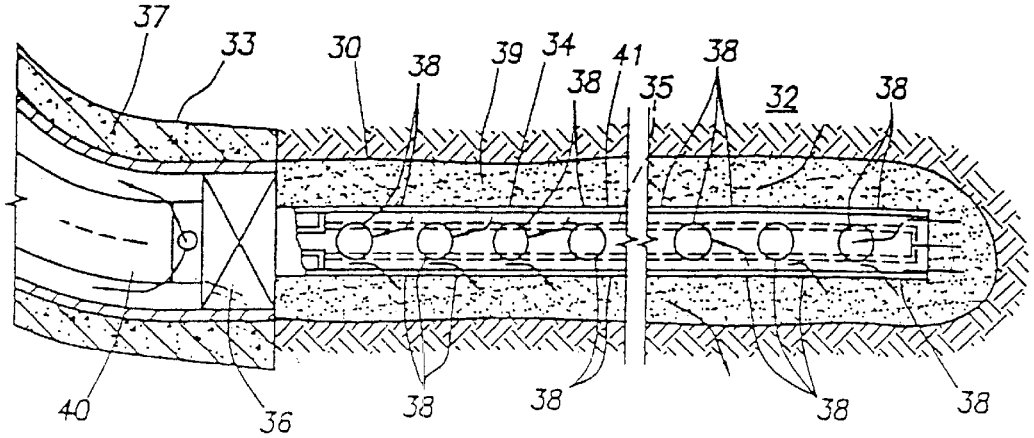
FIG. 6 is a side cross sectional view of a horizontal open-hole well bore penetrating an unconsolidated subterranean producing zone having a slotted liner with an internal sand screen, a production packer and a cross-over connected to a production string disposed therein.
Figure 7:
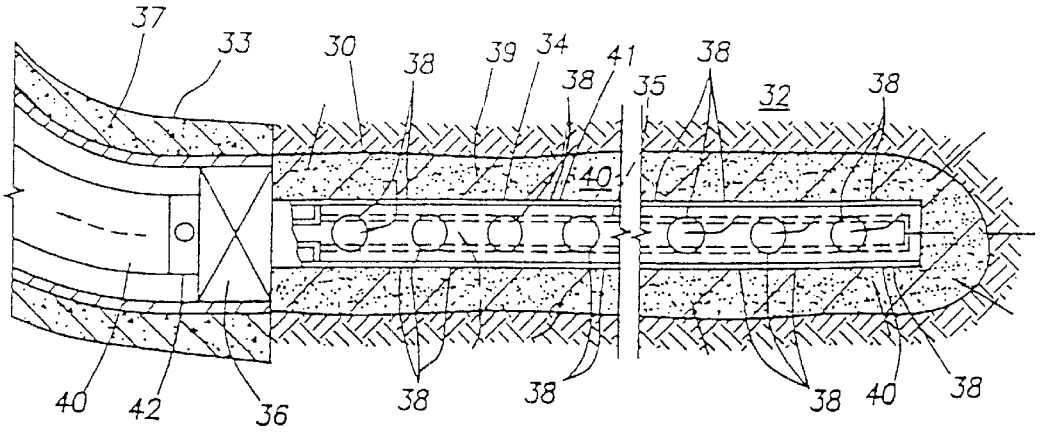
FIG. 7 is a side cross sectional view of the horizontal open hole well bore of FIG. 6 after particulate material has been packed therein.

Referring now to FIGS. 6 and 7, a horizontal open-hole well bore 30 is illustrated. The well bore 30 extends into an unconsolidated subterranean zone 32 from a cased and cemented well bore 33 which extends to the surface. Typically in a horizontal well, the gravel pack will be performed in an open hole, ie. a bore hole which has not been cased. As described above in connection with the well bore 10, a slotted liner 34 has an internal sand screen assembly 35 disposed therein. Channelizers 94 form alternative flow paths 92 in inner annulus 41. The slotted liner 34 and sand screen assembly 35 are connected to a cross-over 42 which is in turn connected to a production string 40. A production packer 36 is connected to the cross-over 42 which is set within the casing 37 in the well bore 33.

In carrying out the methods of the present invention for completing the unconsolidated subterranean zone 32 penetrated by the well bore 30, the slotted liner 34 with the sand screen assembly 35 therein is placed in the well bore 30 as shown in FIG. 6. The outer annulus 39 between the slotted liner 34 and the well bore 30 is isolated by setting the packer 36.

As the slurry passes through ports in the cross-over 42, the velocity of the slurry slows substantially due to the increase in flow area. This reduces the solids-carrying-ability of the fluid. The velocity of the fluid carries the gravel pack slurry along the bottom of the bore hole. The sand will build very quickly around the bottom side of the screen since there is no velocity along the bottom side of the screen thereby allowing the sand to drop out. The gravel pack slurry will flow past the end of the wash pipe and screen until the velocity of the slurry is slowed such that the particulate material will drop out of the fluid due to gravitational pull.

The particulate will begin to build just past the end of the wash pipe on the lower side of the bore hole since there is no leak off for the fluid beyond the end of the wash pipe to drive the gravel pack slurry any further downhole. The slurry will tend to flow back into the lower end of the wash pipe rather than down the open bore hole.

As the fluid continues to move past the end of the wash pipe, the fluid velocity will continue to carry the particulates in an alpha wave onto a node, like a dune, which builds up on the bottom side of the bore hole. The particulate continues to build on the dune at the toe end of the horizontal bore hole as the fluid slows and the particulates drop out. Eventually, the dune reaches the top of the bore hole so as to completely block the bore hole. The first dune is the alpha wave.

As the dune builds, the particulate laden fluid velocity increases and the particulates stay suspended in the fluid longer. As the dune reaches the top of the bore hole, the dune forms a beta wave sending the slurry back up stream while reducing its velocity and depositing particulates. The beta wave is created by the velocity of the slurry which then tends to build and deposit particulates upstream.

Thereafter, as the slurry of particulate material is continually injected into the alternative flow paths 92 in inner annulus 41 between the sand screen 35 and the slotted liner 34 and by way of the slots 38 into the outer annulus 39 between the slotted liner 34 and the well bore 30, the inner and outer annuli 41 and 39 continue to fill. Because the particulate material slurry is free to flow through the slots 38 as well as the open end of the slotted liner 34, the particulate material is uniformly packed into the outer annulus 39 between the well bore 30 and slotted liner 34 and into the inner annulus 41 between the screen 35 and the slotted liner 34. The pack of particulate material 40 formed filters out and prevents the migration of formation fines and sand with fluids produced into the well bore 30 from the subterranean zone 32.

Alternatively, the upper end of slotted liner 34 near packer 36 may be open to receive a flow of the slurry from production string 40. In this instance, the slurry passing through cross-over 42 may flow into both the outer annulus 39 and inner annulus 41 substantially simultaneously or into just outer annulus 39 and then by way of slots 38 and the lower open end of slotted liner 34 into the alternative flow paths 92 in inner annulus 41 to thereby avoid bridging.

The methods and apparatus of this invention are particularly suitable and beneficial in forming gravel packs in long-interval horizontal well bores without the formation of sand bridges. Because elaborate and expensive sand screens including shunts and the like are not required and the pack sand does not require consolidation by a hardenable resin composition, the methods of this invention are very economical as compared to prior art methods.

The particulate material utilized in accordance with the present invention is preferably graded sand but may be a man-made material having a similar mesh size. The particulate material is sized based on a knowledge of the size of the formation fines and sand in the unconsolidated zone to prevent the formation fines and sand from passing through the gravel pack, i.e., the formed permeable sand pack 27 or 40. The graded sand generally has a particle size in the range of from about 10 to about 70 mesh, U.S. Sieve Series. Preferred sand particle size distribution ranges are one or more of 10–20 mesh, 20–40 mesh, 40–60 mesh or 50–70 mesh, depending on the particle size and distribution of the formation fines and sand to be screened out by the graded sand.

The particulate material carrier liquid can be any of the various viscous carrier liquids or fracturing fluids utilized heretofore including gelled water, oil base liquids, foams or emulsions. The foams utilized have generally been comprised of water based liquids containing one or more foaming agents foamed with a gas such as nitrogen. The emulsions have been formed with two or more immiscible liquids. A particularly useful emulsion is comprised of a water based liquid and a liquified normally gaseous fluid such as carbon dioxide. Upon pressure release, the liquified gaseous fluid vaporizes and rapidly flows out of the formation. The liquid utilized is preferably a non-viscous or low viscosity fluid which can also be used to fracture the unconsolidated subterranean zone if desired.

The most common carrier liquid/fracturing fluid utilized heretofore which is also preferred for use in accordance with this invention is comprised of an aqueous liquid such as fresh water or salt water combined with a gelling agent for increasing the viscosity of the liquid. The increased viscosity reduces fluid loss and allows the carrier liquid to transport significant concentrations of particulate material into the subterranean zone to be completed. A variety of gelling agents are described in U.S. Pat. application Ser. No. 09/361,714 filed on Jul. 27, 1999, hereby incorporated herein by reference, which is a continuation-in-part of U.S. application Ser. No. 09/084,906 filed on May 26, 1998, hereby incorporated herein by reference, which is a continuation-in-part of U.S. application Ser. No. 08/951,936 filed on Oct. 16, 1997, hereby incorporated herein by reference. See also European patent application EP 0 909 874 A2 published Apr. 21, 1999 and European patent application EP 0 909 875 A2 published Apr. 21, 1999, both hereby incorporated herein by reference.

Figure 8:
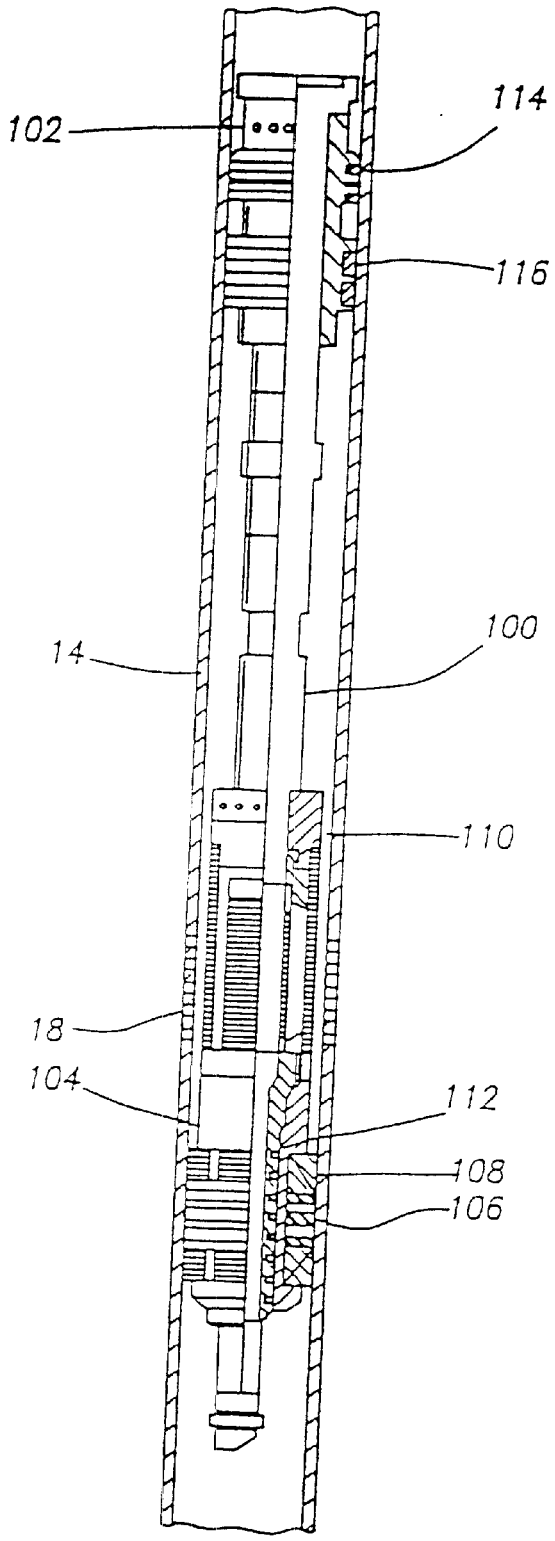
FIG. 8 is a side-cross sectional view of a well bore penetrating an unconsolidated subterranean producing zone having a downhole assembly with the sand screen assembly and slotted outer shroud disposed in casing cemented therein.

Referring now to FIGS. 8 and 9, there is shown a preferred embodiment of the downhole assembly 100 for the present invention. Downhole assembly 100 includes a gravel pack packer 102, such as a "Versa-Trieve" gravel pack packer, suspending internal sand screen assembly 110. Sand screen assembly 110 is shown stabbed into a sump packer 104, such as a "Perma-Series" sump packer. Sump packer 104 is shown in sealing engagement at 106 with casing 14 and maintained in position by slips 108. Sump packer 104 includes a seal bore 112 for sealing engagement with screen assembly 110 hereinafter described. Likewise, gravel pack packer 102 is in sealing engagement at 114 with casing 14 and is maintained in position by slips 116.

Figure 9A:
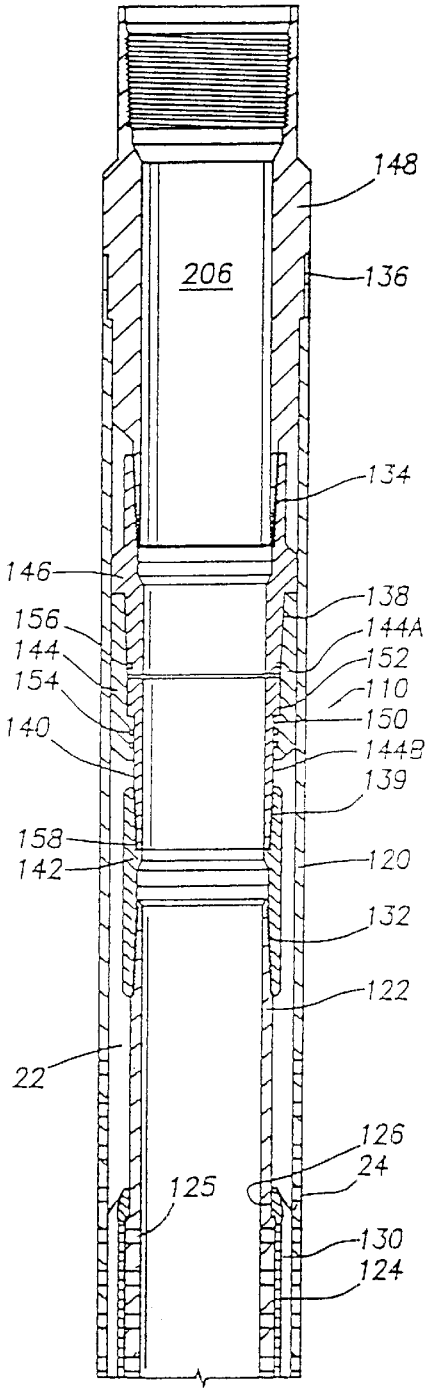
FIGS. 9A and 9B are a side-cross sectional view of the assembly of the internal sand screen assembly and outer slotted shroud.
Figure 9B:
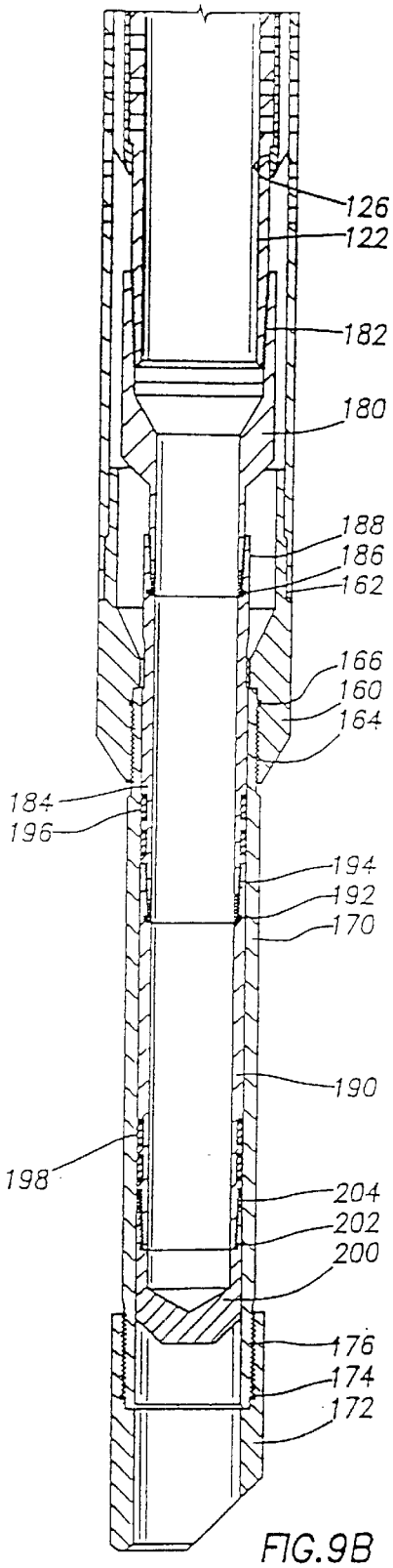

Referring particularly to FIGS. 9*a* and 9*b*, internal sand control assembly 110 is a preferred embodiment of sand control assembly 21, previously described. Sand control assembly 110 includes an outer slotted liner or shroud 120, a slotted inner base pipe 122, a sand screen 124 mounted around base pipe 122, and a plurality of channelizers 130. Base pipe 122 includes a plurality of slots 125 beneath screen 124 for the passage of the gravel pack slurry. It should be appreciated that the slots 125 in base pipe 122 need not be aligned with the slots 24 in outer shroud 120. Outer shroud 120 includes a plurality of slots 24, preferably six rows of slots at 60° intervals around outer shroud 120.

Figure 10:
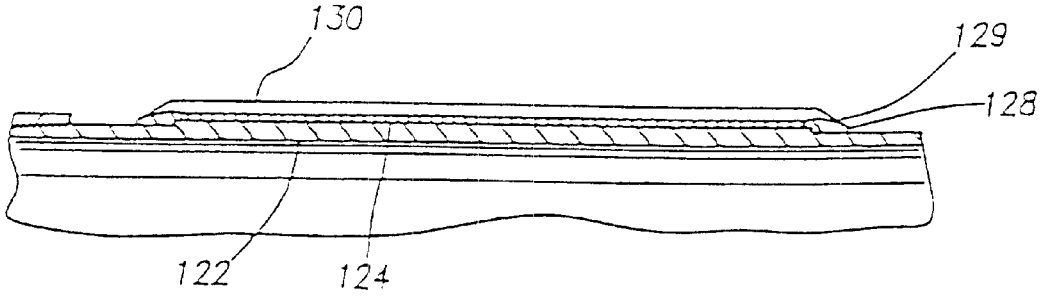
FIG. 10 is an alternative embodiment of attaching the channelizers to the base member of the sand screen assembly.

There are at least three and preferably eight channelizers 130 at 45° intervals around screen 124. This will always provide at least two to four alternative flow paths 90 down through inner annulus 22 to permit leak off through slots 24 in outer shroud 120. Channelizers 130 may be either welded to base pipe 122 as at 126 or as shown in FIG. 10, welded at 129 to a free-rotating ring 128 at each end so as to circumscribe screen 124 to bold channelizers 130 in position. The sand screen 124, even though disposed inside the channelizers 130, is also welded to the base pipe 122. The channelizers 130 are solid members which extend axially the length of screen 124 and extend radially from the outside surface of screen 124 to the inside surface of outer shroud 120. No orientation is required between outer shroud 120 and base pipe 122 or screen 124.

Referring particularly now to FIG. 9*a,* a master connector 148 is connected, such as by threads 136, to the upper end of outer shroud 120 and to a swivel assembly 140. Swivel assembly 140 includes a lower adapter 142, a swivel 144, and an upper adapter 146. The upper adapter 146 is disposed on a reduced diameter portion of master connector 148 such as by threads at 134. The lower adapter 142 is connected, such as by threads at 132, to the upper end of base pipe 122. Swivel 144 rotatably connects upper and lower adapters 142, 146 allowing the threaded engagement of connector 148 to outer shroud 120 without rotating base pipe 122 and screen 124 within outer shroud 120. Seals 156 and 158 are provided between upper adapter 146 and swivel 144 and lower adapter 142 and swivel 144. It can be seen that swivel 144 includes an upper member 144*a* disposed on upper adapter 146, such as by threads 138, and a lower member 144*b* disposed on the upper end of lower adapter 142, such as by threads 139. Upper and lower members 144*a* and *b* include a connection 150 whereby upper member 144*a* may rotate with respect to lower member 144*b* and upper member 144*a* may have limited axial movement with respect to 144*b*. The axial movement is limited by mating shoulders at 152. Connection 150 also includes seals 154 sealingly engaging members 144*a* and 144*b*.

Referring particularly now to FIG. 9*b,* an adapter sub 160 is disposed, such as by threads 162, on the lower end of outer shroud 120. Adapter sub 160 is threaded and sealed at 164, 166, respectively, to a lower seal bore sub 170. Seal bore sub 170 is adapted for stabbing and sealing with sump packer 104, shown in FIG. 8. A guide shoe 172 is sealed and threaded at 174, 176, respectively, on the lower end of seal bore sub 170 to assist in stabbing the sand control assembly 110 into sump packer 104.

A transition adapter 180 is disposed, such as by treads 182, on the lower end of base pipe 122. A first seal sub 184 is sealed and threaded at 186, 188, respectively, on the lower end of reducer adapter sub 180 and a second redundant seal sub 190 is sealed and threaded at 192, 194, respectively, to the lower end of first seal sub 184. Seals 196, 198 are disposed on first and second seal subs 186, 190, respectively, for sealing engagement with the inner surface of outer seal bore sub 170. A closure cap 200 is sealed and threaded at 202, 204, respectively, on the lower end of second seal sub 190 to close the lower end of base pipe 122 and thus flow bore 206 extending through assembly 110. It should be appreciated that outer shroud 120 may or may not be closed at its lower end during gravel packing. Typically, it is closed to allow for an easier assembly.

During gravel packing, the assembly 110 is run into the bore hole below the cross-over 25 in the same trip into the well. It should be appreciated that the cross-over 25 is a conventional gravel pack assembly. Wash pipe 78 is disposed inside base pipe 122 and extends to a point adjacent the lower end of screen 124 for receiving the return fluids from the slurry. This requires that the fluid flow down to the lower end of wash pipe 78 before the fluid can flow through the flowbore of wash pipe 78 to the surface. The wash pipe is sealed at its lower end to base pipe 122 at its upper end to cross-over 25. This inhibits any flow between the small annulus between the wash pipe 78 and base pipe 122. The base pipe 122 and screen 124 are closed at their lower end by closure cap 200 during gravel packing. Since the wash pipe 78 extends to the bottom of the screen 124, the fluids from the slurry are required to enter through the bottom of the wash pipe 78 before they can return to the surface.

The slurry passes through the cross-over 25 and then through the ports 29 into inner annulus 22. The slurry then flows down the alternative flow paths 90 and through slots 24 in outer shroud 122 so as to pass into outer annulus 23. As the fluids leak off into the perforations 18 in casing 14 and return up through the inner flowbore of the wash pipe to the surface, the slurry dehydrates depositing the particulate material, preferably sand, to pack off inner annulus 22 and outer annulus 23 beginning at the bottom of the bore hole. It is preferred that the fluids flow up the wash pipe 78 and work string and not through the perforations 18 into the production zone. It should be appreciated that the slurry flows down not only the outer annulus 23 but through the plurality of flow paths 90 formed by channelizers 130 in inner annulus 22.

Thus, the present invention is well adapted to carry out the objects and attain the ends and advantages mentioned as well as these which are inherent therein. While numerous changes may be made by these skilled in the art, such changes are included in the spirit of this invention as defined by the appended claims.

What is claimed is:

1. An improved method of completing an unconsolidated subterranean zone subject to migration of formation fines and sand with produced fluids penetrated by a well bore having an upper and lower end comprising the steps of:

(a) placing in a lower end of said well bore in said zone a slotted liner having open slots therein and having an internal sand screen disposed therein with dividers extending between the liner and screen whereby a first annulus with alternative flow paths is formed between said sand screen and said slotted liner and a second annulus is formed between said slotted liner and said lower well bore end;

(b) isolating said second annulus between said slotted liner and said lower well bore end in said zone from said upper well bore end; and (c) injecting particulate material into either or both said second annulus between said slotted liner and said well bore and at least one of said flow paths between said sand screen and said slotted liner whereby said particulate material is caused to be packed in said first and second annuli by movement through the open slots in said slotted liner and the migration of formation fines and sand with fluids produced into said well bore from said zone is prevented upon subsequent production of fluids from said subterranean zone.

2. The method of claim 1 wherein said particulate material is sand.

3. The method of claim 1 wherein said well bore in said subterranean zone is open-hole.

4. The method of claim 1 wherein said well bore in said subterranean zone has casing cemented therein with perforations formed through the casing and cement.

5. The method of claim 1 wherein said annulus is isolated in accordance with step (b) by setting a packer in said well bore.

6. The method of claim 1 which further comprises the step of creating at least one fracture in said subterranean zone prior to or while carrying out step (c).

7. The method of claim 6 which further comprises the step of depositing particulate material in said fracture.

8. The method of claim 1, wherein said step of injecting particulate material comprises injecting particulate material into said second annulus between said slotted liner and said well bore.

9. The method of claim 1, wherein said step of injecting particulate material comprises injecting particulate material into at least one of said flow paths between said sand screen and said slotted liner.

10. The method of claim 9, wherein said step of injecting particulate material into at least one of said flow paths comprises injecting particulate material into a plurality of said flow paths.

11. The method of claim 10, wherein said step of injecting particulate material into a plurality of said flow paths comprises injecting particulate material into all of said flow paths between said sand screen and said slotted liner.

12. The method of claim 1, wherein said step of injecting particulate material comprises injecting particulate material into both said second annulus between said slotted liner and said well bore and at least one of said flow paths between said sand screen and said slotted liner.

13. An improved method of completing an unconsolidated subterranean zone subject to migration of formation fines and sand with produced fluids penetrated by an open-hole well bore having an upper and lower end comprising the steps of:

(a) placing in a lower end of said well bore in said zone a slotted liner having open slots therein and having an internal sand screen with dividers extending between the liner and screen whereby a first annulus with alternative flow paths is formed between said sand screen and said slotted liner and a second annulus is formed between said slotted liner and said lower well bore end;

(b) isolating said second annulus between said slotted liner and said lower well bore end in said zone from said upper well bore end;

(c) pumping a slurry of particulate material into either or both said second annulus between said slotted liner and said well bore and at least one of said flow paths between said sand screen and said slotted liner whereby said particulate material is packed in said first and second annuli by passage through the slots in said slotted liner and the migration of formation fines and sand with fluids produced into said well bore from said zone is prevented upon subsequent production of fluids from said zone; and (d) placing said unconsolidated subterranean zone on production.

14. The method of claim 13 wherein said second annulus between said slotted liner and said well bore is isolated in accordance with step (b) by setting a packer in said well bore.

15. The method of claim 13 wherein said well bore in said zone is horizontal.

16. The method of claim 13 which further comprises the step of creating at least one fracture in said subterranean zone prior to or while carrying out step (c).

17. The method of claim 16 which further comprises the step of depositing particulate material in said fracture.

18. The method of claim 13, wherein said step of pumping a slurry of particulate material comprises pumping a slurry of particulate material into said second annulus between said slotted liner and said well bore.

19. The method of claim 13, wherein said step of pumping a slurry of particulate material comprises pumping a slurry of particulate material into at least one of said flow paths between said sand screen and said slotted liner.

20. The method of claim 19, wherein said step of pumping a slurry of particulate material into at least one of said flow paths comprises pumping a slurry of particulate material into a plurality of said flow paths.

21. The method of claim 20, wherein said step of pumping a slurry of particulate material into a plurality of said flow paths comprises pumping a slurry of particulate material into all of said flow paths between said sand screen and said slotted liner.

22. The method of claim 13, wherein said step of pumping a slurry of particulate material comprises pumping a slurry of particulate material into both said second annulus between said slotted liner and said well bore and at least one of said flow paths between said sand screen and said slotted liner.

23. An improved method of completing an unconsolidated subterranean zone penetrated by a well bore having an upper and lower end and having casing cemented therein comprising the steps of:

(a) forming perforations through said casing and cement into said zone;

(b) placing in a lower end of said well bore in said zone a slotted liner having open slots therein and an internal sand screen disposed therein with dividers extending between the liner and screen whereby a first annulus with alternative flow paths is formed between said sand screen and said slotted liner and a second annulus is formed between said slotted liner and said casing in said lower end of said well bore;

(c) isolating said second annulus between said slotted liner and said casing in said lower end of said well bore in said zone from said upper well bore end;

(d) pumping a slurry of particulate material into either or both said second annulus between said slotted liner and said casing and at least one of said alternative flow paths between said sand screen and said slotted liner whereby said particulate material is packed in said first and second annuli by passage through the slots in said slotted liner and in said perforations and the migration of formation fines and sand with fluids produced into said well bore from said zone is prevented upon subsequent production of fluids from said formation.

24. The method of claim 23, wherein said step of pumping a slurry of particulate material comprises pumping a slurry of particulate material into said second annulus between said slotted liner and said well bore.

25. The method of claim 23, wherein said step of pumping a slurry of particulate material comprises pumping a slurry of particulate material into at least one of said flow paths between said sand screen and said slotted liner.

26. The method of claim 25, wherein said step of pumping a slurry of particulate material into at least one of said flow paths comprises pumping a slurry of particulate material into a plurality of said flow paths.

27. The method of claim 26, wherein said step of pumping a slurry of particulate material into a plurality of said flow paths comprises pumping a slurry of particulate material into all of said flow paths between said sand screen and said slotted liner.

28. The method of claim 23, wherein said step of pumping a slurry of particulate material comprises pumping a slurry of particulate material into both said second annulus between said slotted liner and said well bore and said flow paths between said sand screen and said slotted liner.

* * * * *

UNITED STATES PATENT AND TRADEMARK OFFICE

CERTIFICATE OF CORRECTION

PATENT NO. : 6,427,775 B1
DATED : August 6, 2002
INVENTOR(S) : Ronald G. Dusterhoft et al.

It is certified that error appears in the above-identified patent and that said Letters Patent is hereby corrected as shown below:

Column 6,
Line 12, replace “dr” with -- or --.
Line 40, replace “flew” with -- flow --.

Column 7,
Line 58, replace “ie.” with -- i.e. --.

Column 8,
Line 56, replace “ie.” with -- i.e. --.

Column 11,
Line 8, replace “bold” with -- hold --.

Signed and Sealed this

Twenty-second Day of April, 2003

JAMES E. ROGAN
*Director of the United States Patent and Trademark Office*